US009090375B2

(12) United States Patent
Gartz et al.

(10) Patent No.: US 9,090,375 B2
(45) Date of Patent: Jul. 28, 2015

(54) CAKE BASE WITH RECESSES

(71) Applicant: Pactiv LLC, Lake Forest, IL (US)

(72) Inventors: Mark R. Gartz, Mt. Prospect, IL (US); Scott Hanson, Grayslake, IL (US)

(73) Assignee: PACTIV LLC, Lake Forest, IL (US)

( * ) Notice: Subject to any disclaimer, the term of this patent is extended or adjusted under 35 U.S.C. 154(b) by 0 days.

(21) Appl. No.: 13/815,754

(22) Filed: Mar. 15, 2013

(65) Prior Publication Data

US 2014/0262909 A1 Sep. 18, 2014

(51) Int. Cl.
*B65D 1/34* (2006.01)
*B65D 85/36* (2006.01)

(52) U.S. Cl.
CPC . *B65D 1/34* (2013.01); *B65D 85/36* (2013.01)

(58) Field of Classification Search
CPC ..... B65D 85/36; B65D 1/34; B65D 1/36; A47G 19/02; A47G 19/08; A47G 19/10; A47G 19/26; A47G 19/265
USPC ..... 206/551, 557, 560, 467, 477, 478; 220/780, 782, 787, 574, 574.1, 574.2, 220/574.3, 575
See application file for complete search history.

(56) References Cited

U.S. PATENT DOCUMENTS

| | | | | |
|---|---|---|---|---|
| 3,511,288 | A | 5/1970 | Swett et al. | |
| 4,197,940 | A * | 4/1980 | DeRossett | 220/780 |
| 4,553,061 | A | 11/1985 | Germano | |
| 4,705,163 | A | 11/1987 | James | |
| 5,018,624 | A * | 5/1991 | Arneson et al. | 206/560 |
| 5,287,959 | A * | 2/1994 | Hansen et al. | 220/787 |
| D345,894 | S * | 4/1994 | Krupa | D7/554.2 |
| D371,964 | S * | 7/1996 | Krupa | D7/610 |
| 5,685,453 | A | 11/1997 | Goins et al. | |
| 2012/0234717 | A1 | 9/2012 | Kirkland | |
| 2013/0313257 | A1 | 11/2013 | Gartz et al. | |

OTHER PUBLICATIONS

U.S. Appl. No. 29/451,069, filed Mar. 27, 2013.

* cited by examiner

*Primary Examiner* — Andrew Perreault
(74) *Attorney, Agent, or Firm* — Baker Botts L.L.P.

(57) ABSTRACT

Base for a food container includes a base member having a perimeter and a central region, a retaining ring of height H and width W formed between the perimeter and the central region, and extending upwardly from the central region, and a plurality of recesses in the retaining ring, each recess extending across the width W of the retaining ring from the perimeter toward the central region of the base member. Container further includes a lid having a perimeter configured to engage the perimeter of the base member. Method of making a food container is also provided.

22 Claims, 5 Drawing Sheets

CAKE BASE WITH RECESSES

BACKGROUND OF THE INVENTION

1. Field of the Invention

The present disclosed subject matter relates to a food packaging system of a disposable container for packaging and displaying food items, such as cakes. Particularly, the present disclosed subject matter is directed to a base for holding food items, wherein the base has finger recesses that allow for easy removal of the food item from the base while ensuring that the food item does not move within the package.

2. Description of Related Art

Food items, such as baked goods, are often packaged in a container including a base and interlocking lid, each formed of a thermoformed plastic sheet. For purpose of example, a cake generally lies on a cardboard food liner that is, in turn, supported by the base.

A variety of such containers are generally known and available in the art. Examples of such containers are disclosed in U.S. Pat. Nos. 4,705,163 and 4,533,061, each of which is incorporated by reference herein in its entirety. Often it is desirable or necessary for food contents to be supported by a liner or the like, which is disposed on the container base. It is also desirable for the food items to remain centered on the base during shipping, storing and display, while permitting easy removal of the food item.

As such, there remains a need for a food container that allows for centering of a food item on a base, yet allows easy removal of the food item from the base when desired.

SUMMARY OF THE INVENTION

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a base for a food container comprising a base member having a perimeter and a central region. The base member further includes a retaining ring formed between the perimeter and the central region, and a plurality of recesses defined within the retaining ring. Each recess extends across the retaining ring from the perimeter toward the central region of the base member.

As embodied herein, the central region and the retaining ring can be substantially circular in shape. The central region further contains a support structure. The retaining ring has a raised ledge including an outer side wall, a top wall, and an inner side wall. The central region of the base member includes a shoulder having a support surface proximate the retaining ring. The outer wall can be sloped downwards towards the edge of the base. The recesses can project across the width of the retaining ring and into the shoulder. The recesses can be generally arcuate in shape, and can be located diametrically opposite each other. The perimeter further includes a base rim proximate the perimeter, the base rim defining a base channel including an inner wall, a bottom wall, and an outer wall. The base rim can further include a locking feature in the form of lock projections on the inner and outer wall of the base rim.

The base can further comprise a food liner configured to be received within the central region and surrounded and held in place by the retaining ring. The food liner can be sized to be received within the retaining ring, and the thickness of the food liner can be determined as appropriate.

In accordance with another aspect of the disclosed subject matter, a food container is provided including the base as described above in combination with a lid having a perimeter configured to engage the perimeter of the base member. The bottom of the base can include a stacking feature, which can allow the base to be stacked on a substantially similarly shaped container. A method of making the base member is also provided.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the methods and apparatus of the disclosed subject matter. Together with the description, the drawings serve to explain the principles of the disclosed subject matter.

DETAILED DESCRIPTION OF THE PREFERRED EMBODIMENT

Figure 1:
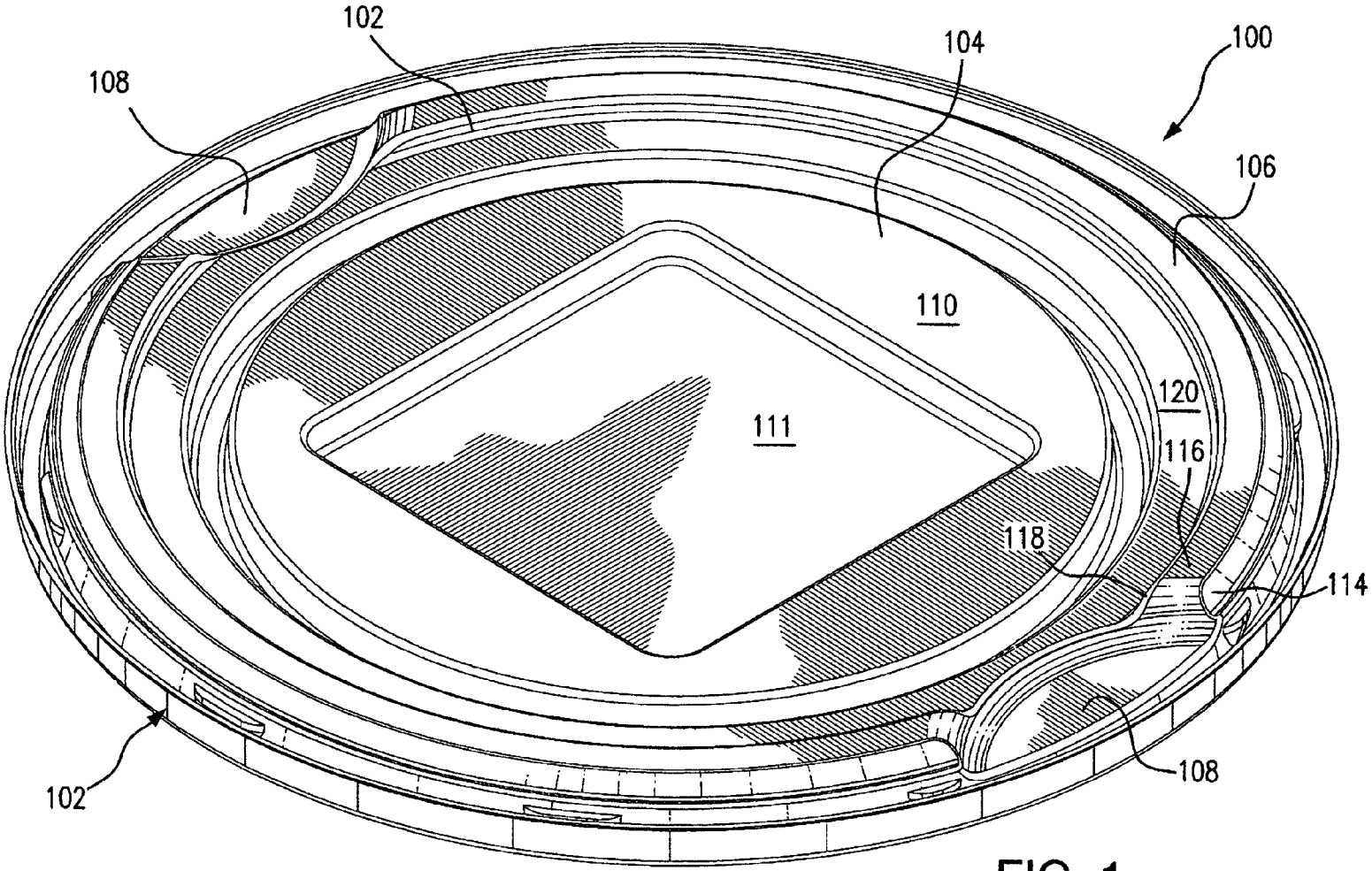
FIG. 1 is a perspective view of an exemplary embodiment of a cake base in accordance with the disclosed subject matter.

The apparatus and methods presented herein can be used for storage, transportation, and display of food items and other perishable and nonperishable products. The disclosed subject matter is particularly suited for storage, transportation, and display of food items disposed on a food liner, wherein the base allows for easy lifting of the food item, in addition to preventing the food item and the food liner from shifting within the package.

In accordance with the disclosed subject matter herein, a base for a food container is provided. The base includes a base member having a perimeter and a central region. A retaining ring is formed between the perimeter and the central region, wherein the retaining ring has a width W and extends upwardly from the central region a height H. Additionally, a plurality of recesses are defined in the retaining ring, each recess extending across the width W of the retaining ring from the perimeter toward the central region of the base member.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the container in accordance with the disclosed subject matter are shown in FIGS. 1-7. The container is suitable for use with a wide variety of perishable and nonperishable food items. However, for purpose of understanding, reference will be made to the use of the container disclosed herein with food items, such as a cake, wherein the container can be used for shipping, serving, storing, preparing and/or re-using such food items.

In the exemplary embodiment shown in FIG. 1, the base member 100 generally includes a perimeter 102 and a central region 104. The central region 104 further includes a support surface 110 to support the contents thereon. The support surface 110 can be a single planar surface or can be provided with indentations or other features such as channels or the like for strength, rigidity and/or aesthetics. For example, as shown in the exemplary embodiment, the support structure 110 includes an indentation 111 of a suitable shape, such as a square in plan view. Additionally or alternatively, the support structure can include multiple indentations, indentations in different shapes, such as rectangular or crescent in plan view, and any other suitable surface formations, such as a textured surface or the like. Additionally, or alternatively, and as depicted in FIG. 1, a shoulder 120 can be disposed within the central region 104 with a support surface proximate the retaining ring, as described in further detail below. Additionally, the support surface 110 and indentation 111 can be used for labeling purposes or the like.

Figure 2:
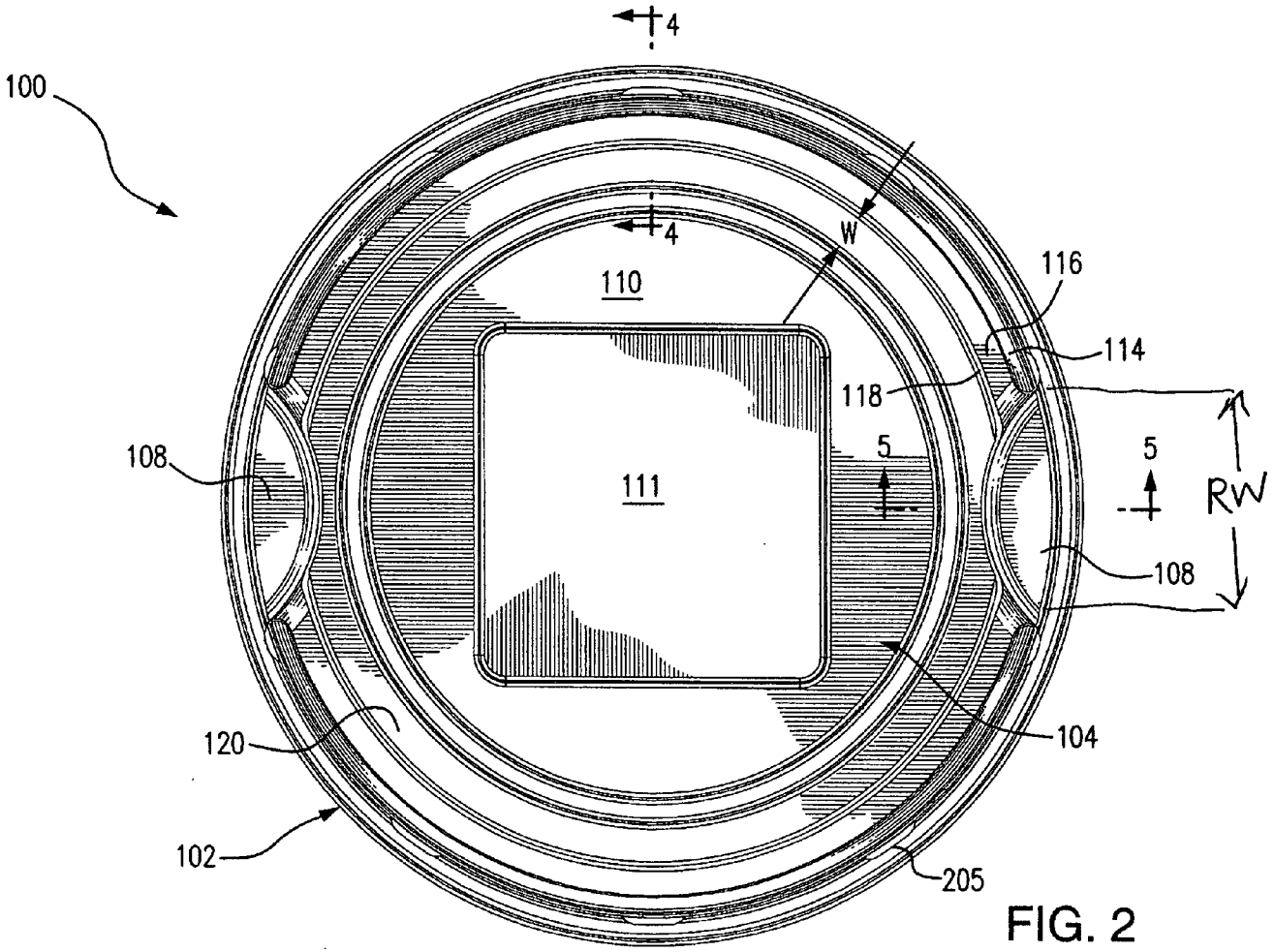
FIG. 2 is a plan view of the cake base of FIG. 1.
Figure 4:
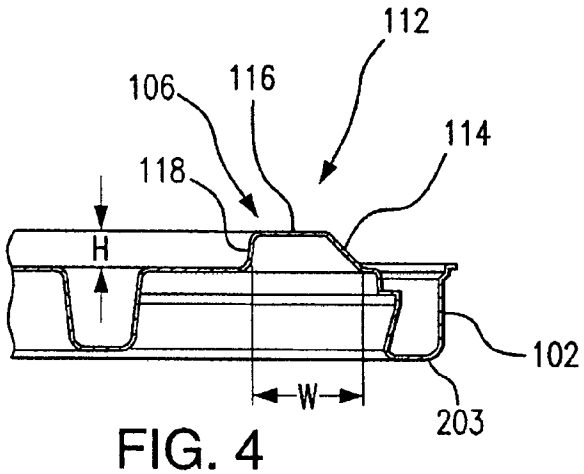
FIG. 4 is an enlarged partial cross-section view of the cake base of FIG. 1, taken along line 4-4 of FIG. 2.

With reference to FIGS. 1-2 and 4, the base member 100 disclosed herein includes a retaining ring 106 formed between the central region 104 and the perimeter 102 of the base member 100. The retaining ring 106 generally has a width W and extends upwards a height H from the central region 104, as shown in an exemplary embodiment in FIG. 4. As embodied herein, the base member 100 and the retaining ring 106 are each generally circular in plan view, as shown in FIG. 2. However, alternative shapes also can be used in accordance with the disclosed subject matter, such as square, rectangular, elliptical shape in plan view, or other suitable shapes. Furthermore, if desired, the retaining ring 106 can be provided with a shape that differs from that of the perimeter 102 and the base member 100 in plan view.

The retaining ring 106 can further have a plurality of recesses 108 defined therein. In the exemplary embodiment as shown in FIG. 1, the retaining ring 106 can be formed as a raised ledge 112, including an outer side wall 114, a top wall 116, and an inner side wall 118. For example and without limitation, the outer side wall 114 can be sloped at an angle from the top wall 116 toward the perimeter 102 as shown in FIG. 1. Alternatively the retaining ring 106 can be provided with a variety of other shapes, such as an inverted V shape with no top wall if desired, wherein the height and width of the retaining ring is suitable to accommodate the purpose for which the base is being utilized.

Figure 5:
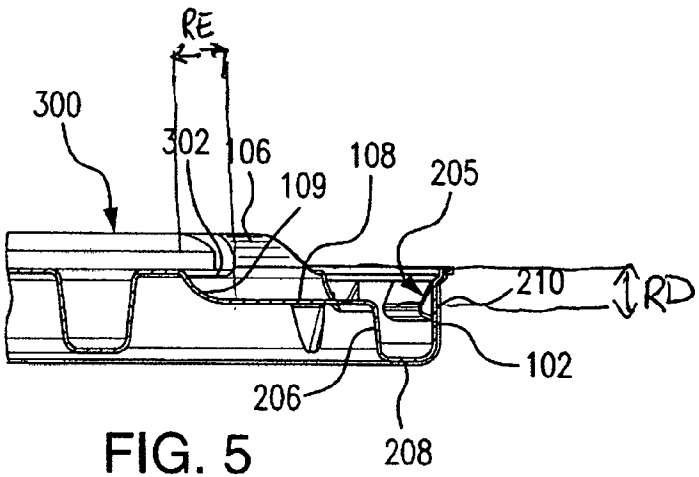
FIG. 5 is an enlarged partial cross-section view of the cake base of FIG. 1, taken along line 5-5 of FIG. 2.

With reference now to FIGS. 1-2 and 5, the base member 100 includes a plurality of recesses 108 defined therein, wherein each recess 108 extends across the width W of the retaining ring 106 from the perimeter 102 toward the central region 104 of the base member 100. For example, as embodied herein, each recess 108 can extend across the width of the retaining ring 106 and into the central region 104. For example, as embodied herein, the base member depicted in FIGS. 1-2 and 5 includes a shoulder 120 having a support surface 110 proximate the retaining ring 106 and each recess extends across the width of the retaining ring 106 and into the shoulder 120. Alternatively, the recesses 108 can extend only partially across the retaining ring 106 without extending into the central region 104. As illustrated in FIGS. 1 and 5, each recess 108 can include an edge wall 109 sloped downwards from the central region 104 and towards the perimeter 102. As shown in the exemplary embodiment, each recess 108 is generally arcuate in shape in plan view. Alternatively, the recesses 108 can be formed in any number of shapes, including rectangular, semicircular, triangular, or any other suitable shape as required. Furthermore, all the recesses 108 need not be formed in the same shape and size. Additionally, any suitable number of recesses 108 can be provided. For example, and as embodied herein, FIGS. 1-2 depict a base member 100 having two recesses 108. As shown in FIGS. 1 and 2, the recesses 108 are located diametrically opposite each other for ease and security of accessing the product contained within the central region 104. However, the location of the recesses 108 can be altered depending on the number of recesses and intended use.

With reference now to FIGS. 2 and 5, for purpose of illustration and not limitation, each recess 108 generally has a width RW and a depth RD. Furthermore, the recess is configured to extend inwardly toward the central region 104 beyond the retaining ring 106, and thus below a food liner 300 if one is provided, by a distance RE. In accordance with a particular aspect of the disclosed subject matter, RE can be at least 0.08 in. or more (for example and as embodied herein, 0.163 in). Additionally, the recess depth RD can range in size between 0.125 in. and 0.75 in. (for example and as embodied herein, 0.279 in.) and the recess width RW can range in size between 1.5 in. and 3.0 in. (for example and as embodied herein, 2.969 in.). In this manner, using the dimensions set forth above for the disclosed subject matter, the recesses 108 can generally accommodate two to four human fingers based on available data.

The base member 100 as detailed above further includes a perimeter 102. The perimeter 102 can be in the form of a simple edge, or as depicted herein, can include a locking feature 204 or similar configuration to receive a lid or the like. Possible configurations include a base rim including a lever or other mechanically operated projection, a simple static projection such a flange, or any other suitable configuration. Additionally, or alternatively, a channel can be provided along the perimeter 102. For example and as shown in FIGS. 4 and 5, a base rim 202 can be provided proximate the perimeter 102 wherein the base rim 202 further defines a base channel 203, including an inner wall 206, a bottom wall 208, and an outer wall 210. In this manner, the base member 100 can further be configured to receive at least a portion of a lid 200. For example, any of a variety of lid configurations can be used in combination with the base member provided herein. Examples of such lid and channel configurations include U.S. patent application Ser. No. 13/481,415, which is incorporated by reference herein in its entirety.

Figure 7:
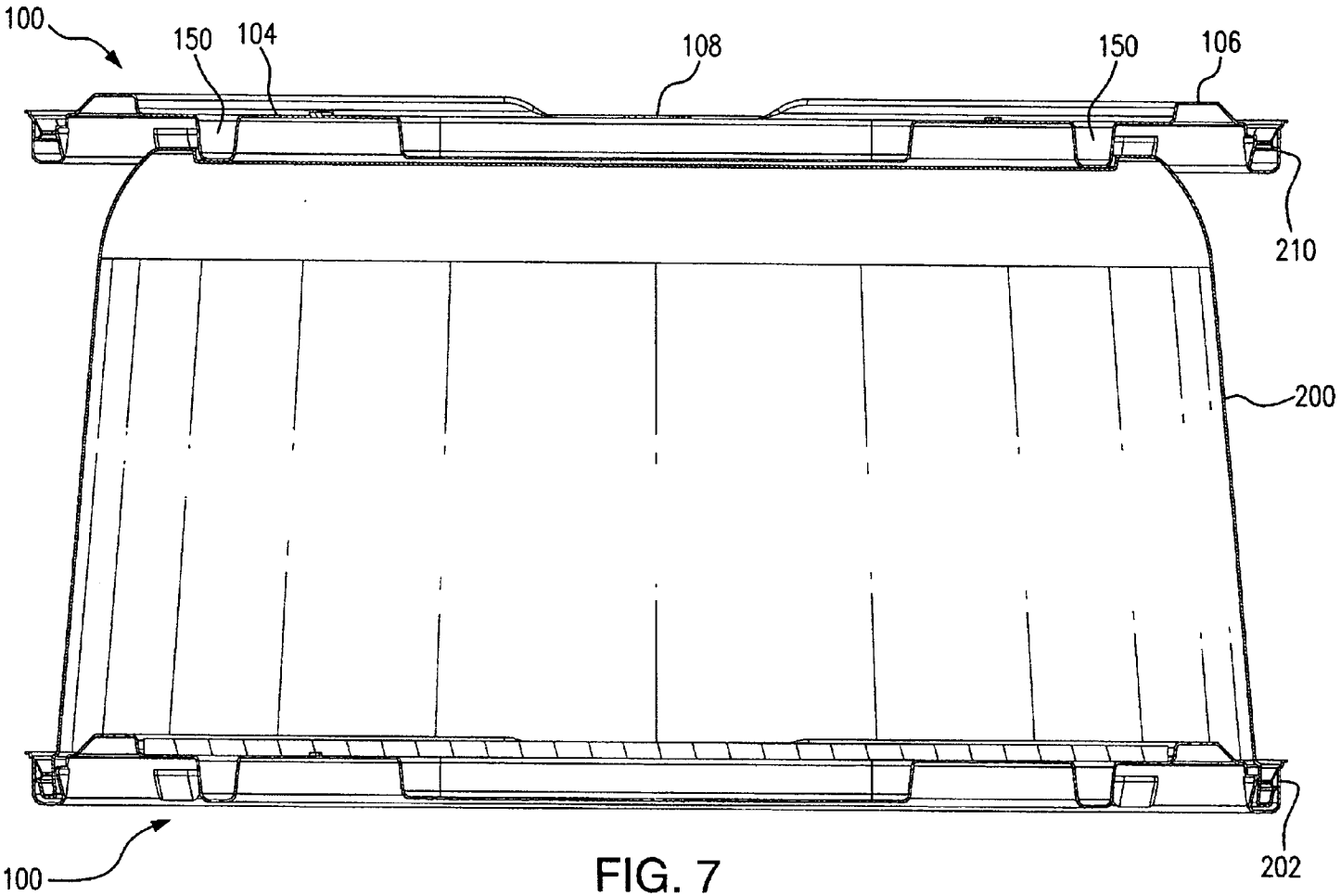
FIG. 7 is a side view of a representative embodiment of a cake base and lid.

For purpose of illustration and not limitation, reference is made to FIG. 7, which depicts the lid 200 secured in the base channel 203 by a locking feature 204. As embodied herein, the locking feature 204 can include lock projections 205 disposed on at least one or both of the side walls 206, 210 of the base channel 202. The lock projections 205 can take any suitable shape, including cylindrical, spherical, or any other shape suitable to holding the lid 200 in place within the base channel 203. Examples of locking features include projections, flanges, mechanisms, or any other suitable feature to secure the lid 200 to the base 100.

Figure 3:
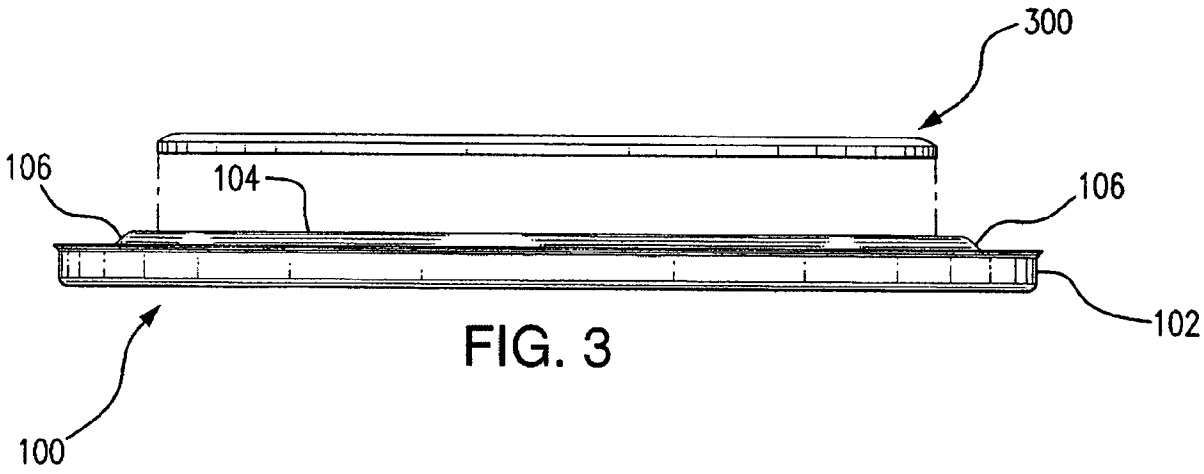
FIG. 3 is an exploded side view of the cake base of FIG. 1 together with a food liner in accordance with the disclosed subject matter.

In accordance with another aspect, the base member 100 can further include a food liner 300. The food liner 300 is generally a support member to support the bottom surface of the food item or the like to be disposed on the base member 100. As depicted in FIGS. 3 and 5, the food liner 300 is shaped to be received within the central region 104 of the base member 100 and substantially surrounded by the retaining ring 106, although any suitable size and shape capable of being received within the central region 104 can be used. As embodied herein, the thickness of the food liner 300 is generally equal to or less than the height H of the retaining ring 106. In this manner, the food liner 300 can rest securely within the base member 100 on the support surface 100 of the central region, with limited movement or ability to shift beyond the retaining ring 106. Furthermore, the recesses 108 provided in the retaining ring 106 allow access to the liner 300 for easy removal as desired. For example, and as depicted in FIG. 5, and as previously noted, the recess 108 extends into the support surface 110 or shoulder 120 of the central region 104 and the liner 300 is sized and shaped to extend beyond the edge of the recess 108. In this manner, the food liner 300 can therefore overhang 302 into the region of the recess 108 to provide access for the food liner 300 to be gripped and/or lifted from the base member 100. The food liner 300 described herein can be manufactured from any suitable material, for example, corrugated cardboard, plastic, paper, or any other suitable material.

Figure 6:
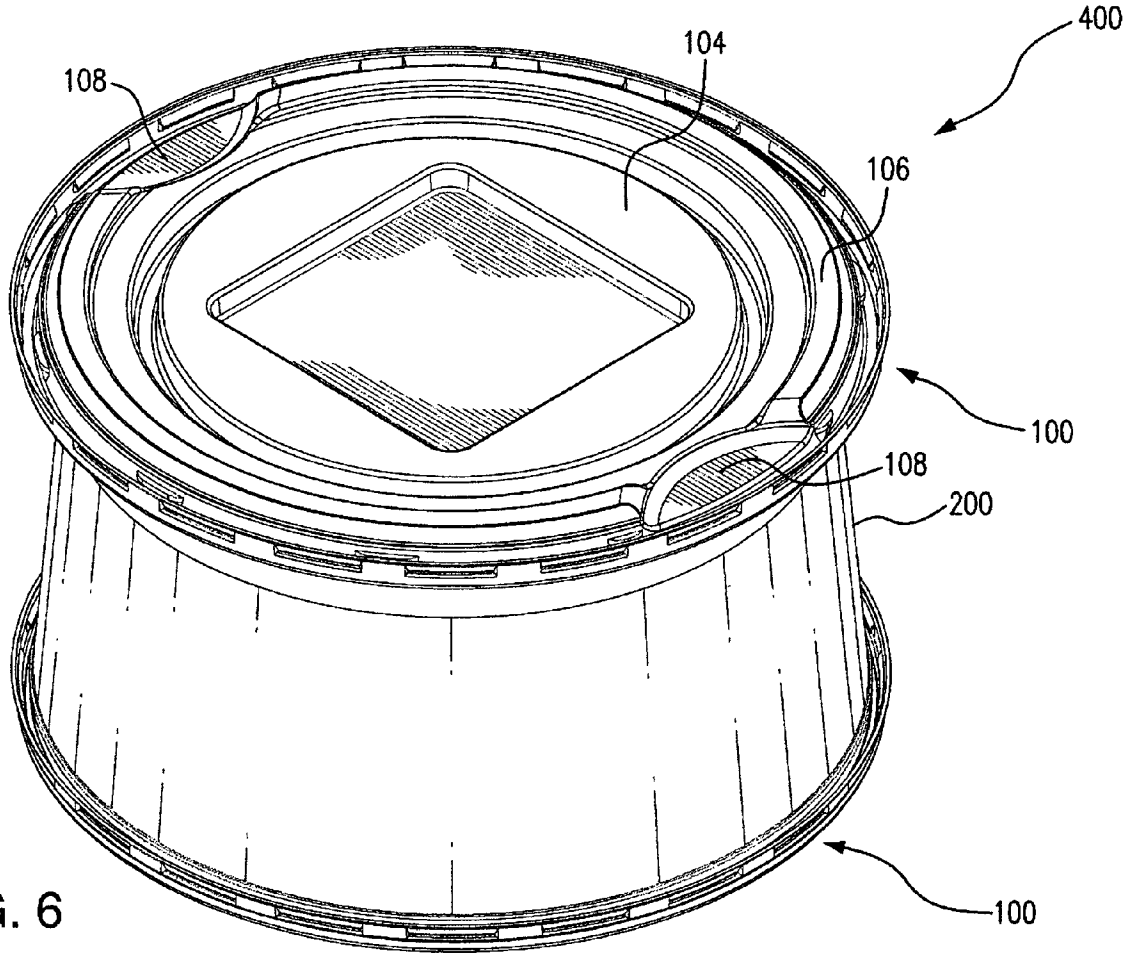
FIG. 6 is a perspective view of a the cake base of FIG. 1 and corresponding lid in accordance with the disclosed subject matter.

The base member 100 and the lid 200 can be combined to form a food container 400, as shown in an exemplary embodiment in FIGS. 6 and 7. Furthermore, the food container 400 can include additional features suitable for the intended purpose, for example and without limitation, vertical stacking of additional food containers 400 or base members 100. As embodied herein, the base can have a base bottom surface defining a base stacking feature 150. The base stacking feature 150 can be shaped to align with and receive a lid stacking feature 210 formed in the lid 200 of a food container 400 of similar configuration. Further, the container 400 desirably, although not necessarily, can have suitable insulating properties to assist in maintaining the temperature and venting properties to control the moisture level within the container. Such features are disclosed in U.S. Patent Publication 2012/0234717 and U.S. patent application Ser. No. 13/481,415, each of which is incorporated reference herein in its entirety. Additionally, the lid of the container 400 can be transparent to allow for the display of the food item therein.

A method of manufacturing a base, as well as a container having such base, is also provided. Generally, the method comprises providing a sheet of plastic material and shaping the sheet into a base member. The base member can include a perimeter and a central region, a retaining ring formed between the perimeter and a central region. The retaining ring can have a width W extending upwardly from the central region and a height H, and a plurality of recesses defined therein. Each recess can extend across the width W of the retaining ring from the perimeter toward the central region of the base member.

The base and lid described herein can be manufactured from any suitable material, for example and without limitation, expanded polystyrene foam, oriented polystyrene (OPS), polypropylene, mineral filled polypropylene, amorphous polyethylene terephthalate (APET), thermoplastics, and paper. It is to be understood that the foregoing list is not exhaustive, and that the containers can be made from other suitable materials. In one exemplary embodiment, a base member 100 and lid 200 having the features described herein is each formed respectively from a single sheet of polymeric material. The material of the base member 100 can be the same as the material of the lid 200, or each can be formed of a different material. For example, the base member 100 can be formed of an opaque polymeric material, while the lid 200 can be formed of a transparent polymeric material. Forming a base member 100 can include providing a sheet of polymeric material, or other suitable material, and forming the material into a base member 100 having various features described herein. Forming a lid 200 can include providing a sheet of polymeric material, or other suitable material, and forming the material into a base 100 having various features described herein. The base member 100 and lid 200 can be formed utilizing any conventional type of thermoforming, stamping, or molding process, or other suitable process.

The base member 100 and lid 200 disclosed herein can be made of a durable construction for multiple use and washing between uses, or can be made for disposable, single use. Also, the base and lid can be constructed from materials suitable to be placed in a heating apparatus, such as a microwave, to heat the food and/or used for storage in the refrigerator or freezer.

It is to be recognized that the dimensions and relative proportions of the container will vary according to the size and intended use of the container and related contents. While a generally circular base 100, lid 200, and food container 400 are illustrated in FIGS. 1-7, one of ordinary skill will recognize that any suitable shape and size can be employed and the disclosed subject matter is not so limited. Other suitable shapes include rectangles, triangles, ovals, various polygons, etc.

While the disclosed subject matter is described herein in terms of certain preferred embodiments, those skilled in the art will recognize that various modifications and improvements can be made to the disclosed subject matter without departing from the scope thereof. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. For example and without limitation, a food container according to the disclosed subject matter can have any suitable shape, and can have any suitable number of lever projections and lock projections configured with any of the closure and release mechanism configurations described herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A base for a food container comprising:

a base member having a perimeter and a central region, the central region including a shoulder;

the base member further having a retaining ring formed between the perimeter and the central region, the retaining ring having a width W and extending upwardly from the central region a height H, the shoulder defining at least a portion of a support surface proximate the retaining ring; and the base member further having a plurality of recesses defined therein, each recess extending across the width W of the retaining ring from the perimeter and into the shoulder.

2. The base of claim 1, wherein the base member is substantially circular in plan view.

3. The base of claim 1, wherein the retaining ring is substantially circular in plan view.

4. The base of claim 1, wherein the central region further comprises a support structure defining at least a portion of the support surface.

5. The base of claim 1, wherein the retaining ring comprises a raised ledge including an outer side wall, a top wall, and an inner side wall.

6. The base of claim 5, wherein the outer side wall of the retaining ring is sloped at an angle from the top wall toward the perimeter.

7. The base of claim 1, wherein each recess includes an edge wall angled downward relative the at least a portion of the support surface defined by the shoulder.

8. The base of claim 1, wherein each recess is generally arcuate in shape in plan view.

9. The base of claim 1, wherein at least two of the plurality of recesses are located diametrically opposite each other.

10. The base of claim 1, wherein each of the plurality of recesses has a width RW, a depth RD, and extends under the food liner by a distance RE, wherein RE is 0.08 in. or more, RD is between 0.125 in. and 0.75 in., and RW is between 1.5 in and 3.0 in.

11. The base of claim 1, wherein the base member further comprises a locking feature configured to engage a lid.

12. The base of claim 1, wherein the base member further comprises a base rim proximate the perimeter, the base rim defining a base channel including an inner wall, a bottom wall, and an outer wall.

13. The base of claim 12, wherein the base channel is configured to receive a portion of a lid.

14. The base of claim 13, wherein the base member further comprises a locking feature, the locking feature comprising lock projections on at least one of the inner and outer walls of the base channel.

15. The base of claim 1, wherein the base further comprises a food liner.

16. The base of claim 15, wherein the food liner is shaped to be received within the central region of the base member and substantially surrounded by the retaining ring.

17. The base of claim 15, wherein the food liner has a thickness equal to or less than height H of the retaining ring.

18. The base of claim 1, wherein the base member is made of sheet plastic.

19. A base for a food container comprising:

a base member having a perimeter and a central region, the central region including a shoulder;

the base member further having a retaining ring formed between the perimeter and the central region, the retaining ring having a width W and extending upwardly from the central region a height H, the shoulder defining at least a portion of a support surface proximate the retaining ring; and the base member further having a plurality of recesses defined therein, each recess extending a depth RD below the support surface and across the width W of the retaining ring from the perimeter and into the shoulder.

20. A food container comprising:

a base comprising:

a base member having a perimeter and a central region, the central region including a shoulder, the base member further having a retaining ring formed between the perimeter and the central region, the retaining ring having a width W and extending upwardly from the central region a height H, the shoulder defining at least a portion of a support surface proximate the retaining ring, and the base member further having a plurality of recesses defined therein, each recess extending a depth RD below the support surface and across the width W of the retaining ring from the perimeter and into the shoulder; and a lid having a perimeter configured to engage the perimeter of the base member.

21. The food container of claim 20, wherein the base has a base bottom surface with a stacking feature to allow the base to be stacked on a lid of a substantially similarly shaped container.

22. A method for manufacturing a base, comprising:

providing a sheet of plastic material; and shaping the sheet of plastic into a base member, the base member having:

a perimeter and a central region, the central region including a shoulder, a retaining ring formed between the perimeter and the central region, the retaining ring having a width W and extending upwardly from the central region a height H, the shoulder defining at least a portion of a support surface proximate the retaining ring, and a plurality of recesses defined therein, each recess extending across the width W of the retaining ring and into the shoulder.

* * * * *